United States Patent [19]

Bailey et al.

[11] Patent Number: 5,040,600

[45] Date of Patent: Aug. 20, 1991

[54] GEOTHERMAL WELLHEAD REPAIR UNIT

[75] Inventors: Thomas F. Bailey; James N. Strickland, both of Houston, Tex.

[73] Assignee: Drilex Systems, Inc., Houston, Tex.

[21] Appl. No.: 540,712

[22] Filed: Jun. 20, 1990

Related U.S. Application Data

[62] Division of Ser. No. 313,688, Feb. 21, 1989, Pat. No. 4,984,636.

[51] Int. Cl.[5] ..... E21B 33/129

[52] U.S. Cl. ..... 166/277; 166/182; 166/192; 166/386

[58] Field of Search ..... 166/277, 123, 125, 135, 166/181, 182, 192, 196, 133, 377, 381, 386

[56] References Cited

U.S. PATENT DOCUMENTS 3,802,509 4/1974 Grable et al. ..... 166/377

4,452,304 6/1984 Barrier et al. ..... 166/70

*Primary Examiner*—Terry L. Melius

*Attorney, Agent, or Firm*—Edgar A. Zarins; Malcolm L. Sutherland

[57] ABSTRACT

A geothermal wellhead repair unit including a mechanically set packer to isolate the wellhead for removal and repair thereof. The packer is run into the well string using a running tool. The packer is set by placing tension on the mandrel to set the packing elements and the slip assembly. Once the packer is set, the running tool can be disengaged without fear of collapsing the packer and the wellhead removed for repair or replacement. Upon replacement of the wellhead, the running tool can be used to unset and retrieve the packer.

10 Claims, 3 Drawing Sheets

GEOTHERMAL WELLHEAD REPAIR UNIT

This is a divisional of copending application Ser. No. 07/313,688 filed on 2/21/89, U.S. Pat. No. 4,984,636.

BACKGROUND OF THE INVENTION

I. Field of the Invention

This invention relates to a unit for isolating a wellhead for removal and repair of the wellhead and, in particular, to a packer for a wellhead repair unit which securely packs off the well to permit safe removal of the wellhead and which subsequently can be retrieved mechanically to allow continued production.

II. Description of the Prior Art

Various devices have been developed to isolate a well for removal and repair of the wellhead in a geothermal well. The extreme temperatures and pressures found in geothermal wells makes it important to safely seal off the well prior to removal of the wellhead. The prior known repair systems utilize a hydraulically set packer which is dependent upon the pressure balance between the downhole pressure and the hydraulic pressure applied through the running tool from the surface. Some tools include means for increasing the gripping action within the casing in the event downhole pressure increases. To release the packer once the repairs are completed and the wellhead is replaced, the hydraulic pressure is increased to overcome the downhole pressure.

Because the past known repair units are dependent upon a critical pressure balance, variations in the downhole pressure can cause release and travel of the packer or in the extreme case a blowout of the tool. Pressure variations may also cause the hydraulically set packer to slip down into the casing. However, because the retrieval tool has limited downhole reach, re-engagement may not be possible requiring other fishing techniques or lost production. Alternatively, an increase in downhole pressure can cause the packer to form a harder grip with the casing wall requiring an increased hydraulic pressure to release the packer and possibly damaging the casing.

Other packers are well known for a variety of applications. However, not all packers are suitable for the environment of a geothermal well. Moreover, many packers are not retrievable and are merely drilled out when further work is needed on the well. These are not suitable alternatives for a completed and operated geothermal well.

SUMMARY OF THE PRESENT INVENTION

This invention overcomes the disadvantages of the prior known geothermal wellhead repair units by providing a mechanically set and released packer for the repair unit which securely packs-off the geothermal well to facilitate removal and repair of the wellhead.

The geothermal wellhead repair unit of the present invention generally comprises a hydraulic extension assembly attachable to the top flange of the wellhead valve, a running tool extending through an upper seal assembly and connected to a well packer. The hydraulic extension assembly includes hydraulic cylinders for the controlled insertion and retraction of the running tool and packer to the desired position within the casing. The packer includes a plurality of packing elements disposed near the lower end of the tool and separated by packing spacers, a slip assembly for selective engagement with the casing wall, a drag block to facilitate setting, a J-slot assembly for independent retraction of the mandrel relative to the outer sleeve assembly, and a means for equalizing the pressure above and below the packer prior to retrieving the packer from the hole. The packer is set by applying an upward force to the mandrel following disconnection of the J-assembly to set the slips and packing elements and close the equalizer port. In order to subsequently release the packer additional upward force is applied to shear the release screw and ratchet ring. Alternatively, the ratchet ring and ratchet sleeve may be threadably disconnected to release the packer.

The method of the present invention allows mechanical isolation of a wellhead for repair or replacement of the wellhead of a geothermal well. The repair unit is attached to the top flange of the wellhead valve. The hydraulic cylinders are then retracted to push the packer into the well bore until the packer reaches the desired depth. Following setting of the packer, the running tool is released from the packer and pulled from the well. The wellhead can now be repaired or replaced. Once repaired/replaced, the repair unit is again attached to the top flange and the running tool is run through the wellhead into the hole for re-engagement with and release of the packer. Once the packer is released, the entire unit can be retrieved and removed from the wellhead.

Other objects, features and advantages of the invention will be apparent from the following detailed description taken in connection with the accompanying drawings:

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views and in which.

DETAILED DESCRIPTION OF A PREFERRED EMBODIMENT OF THE PRESENT INVENTION

Figure 1:
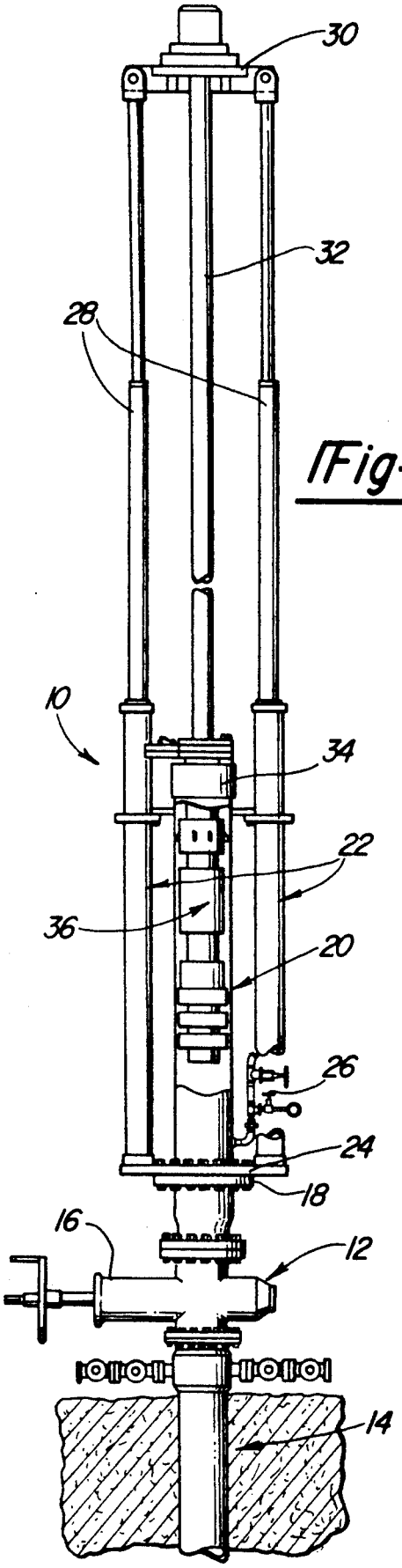
FIG. 1 is a perspective view of the Geothermal Wellhead Repair Unit embodying the present invention mounted to a wellhead of a well bore.

Referring first to FIG. 1, there is shown the geothermal wellhead repair unit 10 embodying the present invention secured to a wellhead 12 of a geothermal well bore 14. The wellhead 12 may include a wellhead valve 16 which may periodically need to be replaced or removed and repaired for continued production of the well. The wellhead 12 preferably includes a top flange 18 to which production apparatus such as the repair unit 10 can be connected for fluid communication with the wellhead 12 and the well 14. It is to be understood that the repair unit 10 may be attached to the wellhead 12 in any number of ways including using connecting clamps. Thus, the present invention provides a repair unit 10 which can be readily attached to a conventional wellhead 12 to facilitate removal or repair of the wellhead valve 16.

Referring to FIG. 1 in particular and the remaining drawings in general, the repair unit 10 includes a lubricator assembly 20 and hydraulic cylinders 22 positioned parallel to the lubricator 20. The lubricator 20 and hydraulic cylinders 22 are connected to a mounting flange 24 to mount the repair unit 10 to the wellhead 12. The lubricator 20 may include a blooie line 26 to bleed the pressure from within the lubricator chamber. The hydraulic cylinders 22 include telescoping extension arms 28 which operate to move a connecting yoke 30 upwardly or downwardly. Connected to the yoke 30 is at least one section of running string 32 which extends into the lubricator 20. The running string 32 extends through a packing gland 34 at the upper end of the lubricator 20 to prevent fluid leakage out of the lubricator 20 past the running string 32. Thus, as the arms 28 of the hydraulic cylinders 22 are retracted the running string 32 will extend through the lubricator 20 and the well head 12 into the well bore 14.

Figure 2:
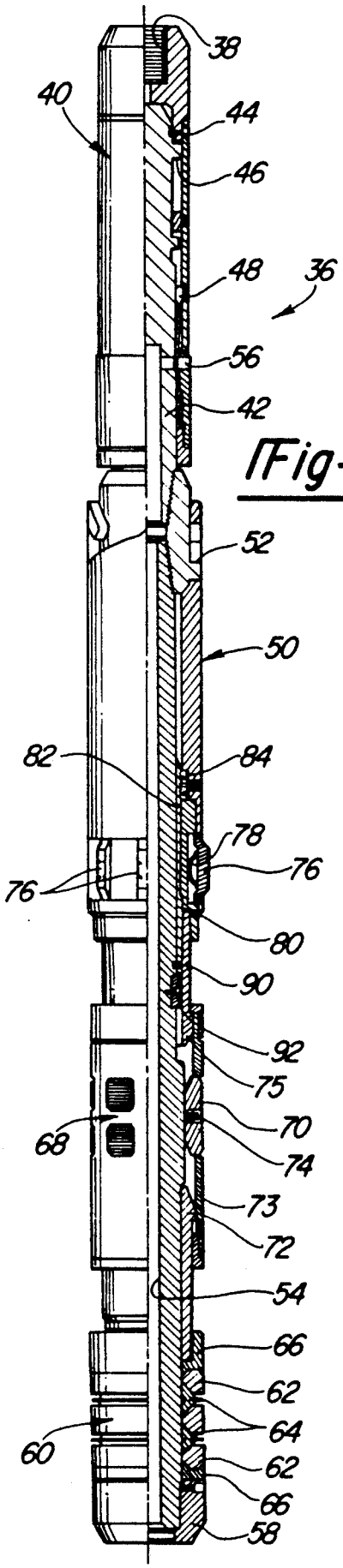
FIG. 2 is a partial cross-sectional perspective of the well packer forming a part of the present invention.

Initially disposed within the lubricator 20 is a packer 36 connected to the end of the running string 32. The packer 36 is adapted to be run into the well 14 using the running string 32 and mechanically set below the wellhead 12 to isolate the wellhead 12 for removal of the valve 16 as will be subsequently described. Referring now to FIG. 2 which shows the mechanically set and unset packer 36 embodying the present invention, the packer 36 is connected to the running string 32 by a pin 38 which forms a portion of a connector sub 40 utilized to selectively connect and disconnect the running string 32 to the packer 36 during operation of the repair unit 10. The connector sub 40 is releasably attached to the upper end of an inner mandrel 42 of the packer 36 which extends substantially the length of the packer 36. The sub 40 is connected to the mandrel 42 against rotation by a shear screw 44 and against longitudinal movement by a pin and slot arrangement 46. A series of flexible fingers 48 facilitate reconnection of the sub 40 to the mandrel 42 as will be subsequently described.

Mounted coaxially to the inner mandrel 42 is an outer sleeve assembly 50 which carries the setting components of the packer 36. The sleeve assembly 50 is releasably secured to the inner mandrel 42 by a J-latch 52 which allows the inner mandrel 42 and sleeve assembly 50 to be simultaneously run into the bore 14 and upon unlatching, allows longitudinal movement of the mandrel 42 relative to the sleeve assembly 50 to set the packer 36. The mandrel 42 includes a partial axial bore 54 to open to the bottom of the packer 36 and extending upwardly to a point above the sleeve assembly 50. A lateral selectively closable port 56 provides fluid communication between the bore 54 and the exterior of the packer 36. The partial bore 54 and port 56 act as an equalizing passageway as the packer 36 is run into the hole 14 and prior to retrieving the packer 36. The equalizing passageway is closed after the packer 36 is set and opened prior to release of the packer 36.

Secured to the lower end of the mandrel 42 is a nose end 58. The nose 58 abuts and engages packing means 60 coaxially mounted to the mandrel 42. The packing means 60 preferably includes at least one compressible packing element 62 separated by packing spacers 64. The packing elements 62 and spacers 64 are positioned between retainer rings 66. Positioned longitudinally above the packing means 60 is slip means 68 which includes at least one slip 70 selectively engageable with the well casing 14 to secure the packer 36 against longitudinal movement within the hole. The slip means 68 includes upper and lower slip cones 72 which travel beneath the slips 70 to move the slips 70 into engagement with the casing 14 as will be subsequently described. The slips 70 are biased inwardly by slip spring 74 to facilitate release of the slips once the slip cones 72 are retracted from beneath the slips 70. Positioned above the slip means 68 are a plurality of drag blocks 76 which aid in setting the packer 36 by creating a frictional drag against the casing 14 to inhibit movement of the sleeve assembly 50 as tension is placed on the mandrel 42. The drag blocks 76 are biased outwardly into engagement with the well bore 14 by a drag block spring 78.

Figure 5:
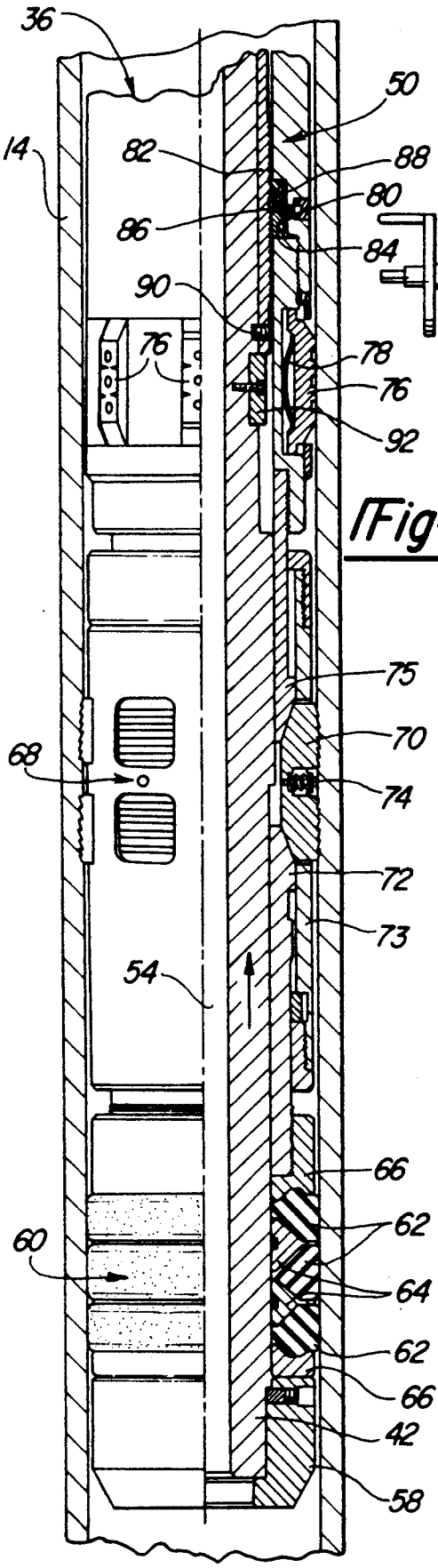
FIG. 5 is an enlarged perspective of the well packer set within the well bore.
Figure 6:
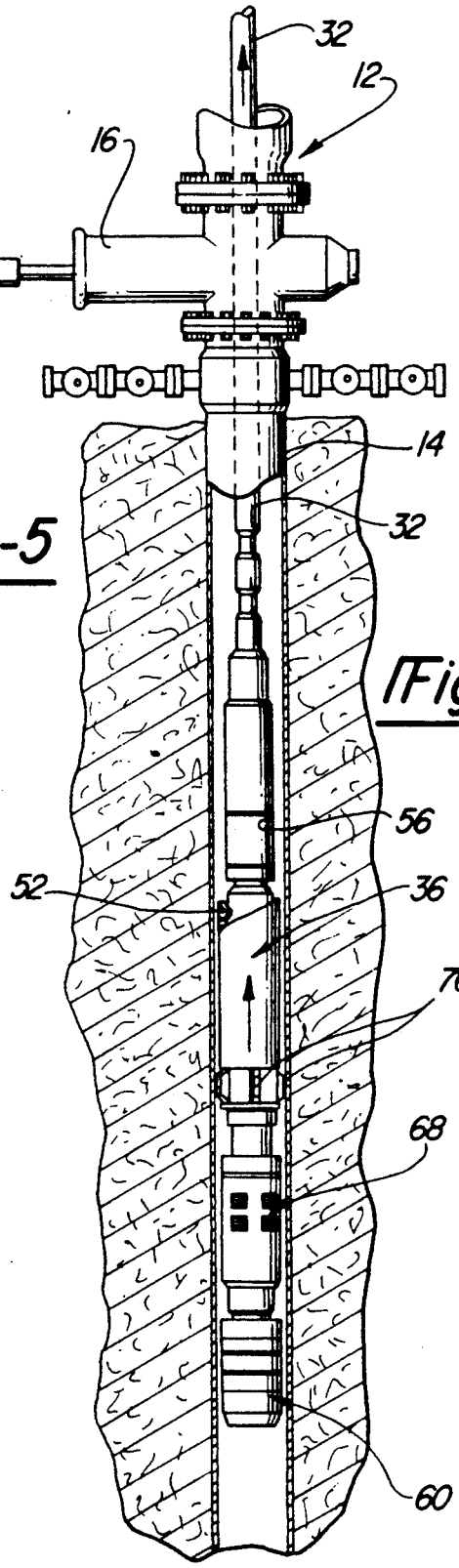
FIG. 6 is a perspective view of the present invention with the well packer being retrieved form the well bore.

Referring to FIG. 2 and 5, the packer 36 includes locking ratchet means 80 to lock the sleeve assembly 50 against movement relative to the mandrel 42 which would release the packer 36. In a preferred embodiment, the locking ratchet means 80 is positioned beneath the drag blocks 76 and includes a ratchet sleeve 82 secured to the mandrel 42 and a ratchet nut 84 mounted to the sleeve assembly 50. The ratchet nut 84 is mounted to the sleeve assembly 50 by a set screw 86 and biased radially inwardly into engagement with the ratchet sleeve 82 by at least one ratchet spring 88. The ratchet sleeve 82 is coaxially mounted to the mandrel 42 and selectively secured against movement relative to the mandrel 42 by at least one shear screw 90. The ratchet sleeve 82 and ratchet nut 84 have cooperating ratchet surfaces which allow relative movement in a first direction to set the packer 36 but prevents relative longitudinal movement in a second direction to release the packer 36. A ratchet sleeve key 92 positions the ratchet sleeve 82 while aiding movement to set and lock the packer 36.

Figure 3:
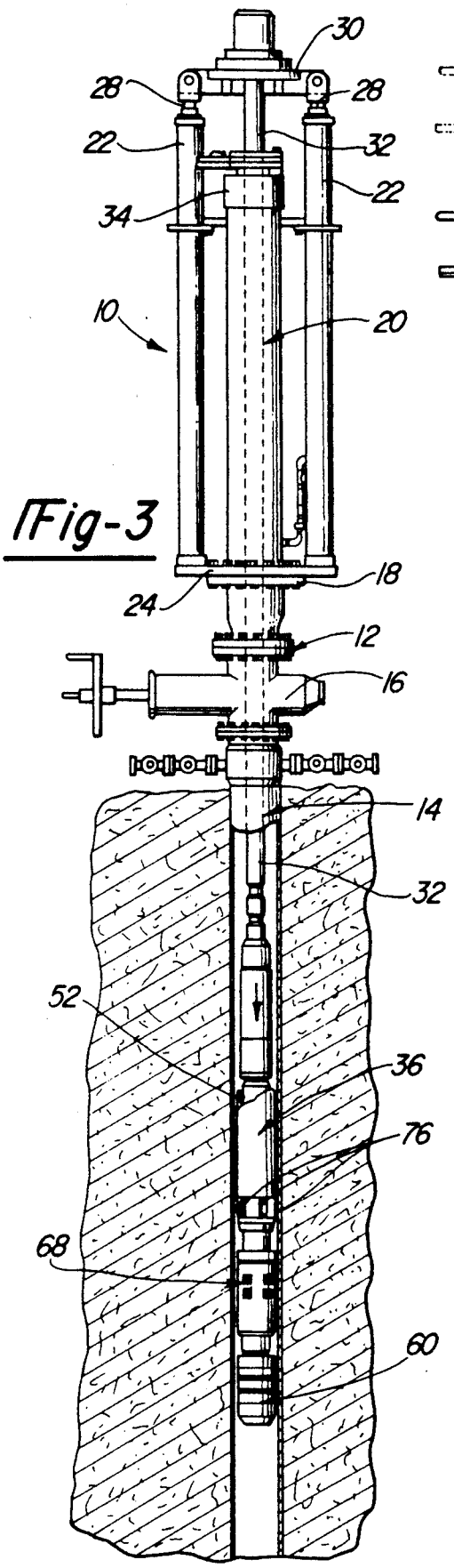
FIG. 3 is a perspective view of the present invention with the well packer being run into the well bore.

Operation of the present invention allows the isolation of the wellhead 12 by setting the packer 36 below the wellhead 12 and subsequent retrieval of the packer 36 for continued operation of the well 14. Referring to the drawings, the repair unit 10, having the packer 36 positioned within the lubricator 20, is attached to the top flange 18 of the wellhead valve 16 (FIG. 1). After opening the valve 15, the hydraulic cylinders 22 are retracted to push the running string 32 and packer 36 through the wellhead 12 into the well bore 14 (FIG. 3) Additional sections of running string 32 can be added until the desired setting depth for the packer 36 has been reached. In a preferred embodiment, once the desired depth is reached, the packer 36 is set by extending the cylinders 22 to pull up on the running string 32 approximately one inch while rotating the string 32 counterclockwise to unlatch the lower J-latch 52. Continued extension of the hydraulic cylinders 22 will set the packer 36. Approximately 40,000 lbs. of tension must be applied to fully set the packer 36.

As best shown in FIG. 5, the packer 36 is set following unlatching the J-latch 52 by pulling upwardly on the inner mandrel 42. With the mandrel 42 unlatched from the sleeve assembly 50, the drag blocks 76 will create a frictional resistance with the casing 14 to inhibit longitudinal movement of the sleeve assembly 50 as the mandrel 42 moves upwardly. Upward tension on the mandrel 42 will cause the nose 58 to initially compress the packing elements 62 into engagement with the casing 14. Continued tension will move lower slip cone 72 and the slip body 73 upwardly toward the upper slip cone 75 until the slip body 73 engages the drag blocks 76 allowing the lower slip cone 72 to pass beneath the slips 70. As the slip cones 72 and 75 move beneath the slips 70, the sloped surfaces of the cones will force the slips 70 outwardly into engagement with the casing. Continued tension will fully compress the packing elements 62 into sealing engagement with the casing. As the mandrel 42 is drawn upwardly relative to the sleeve assembly 50, the ratchet sleeve 82 will move beneath the ratchet nut 84 engaging the cooperating ratchet teeth. The orientation of the ratchet teeth allows upward movement of the mandrel 42 relative to the sleeve assembly 50 to set the packer but will not allow the mandrel 42 to move downwardly to release the packer 36.

Figure 4:
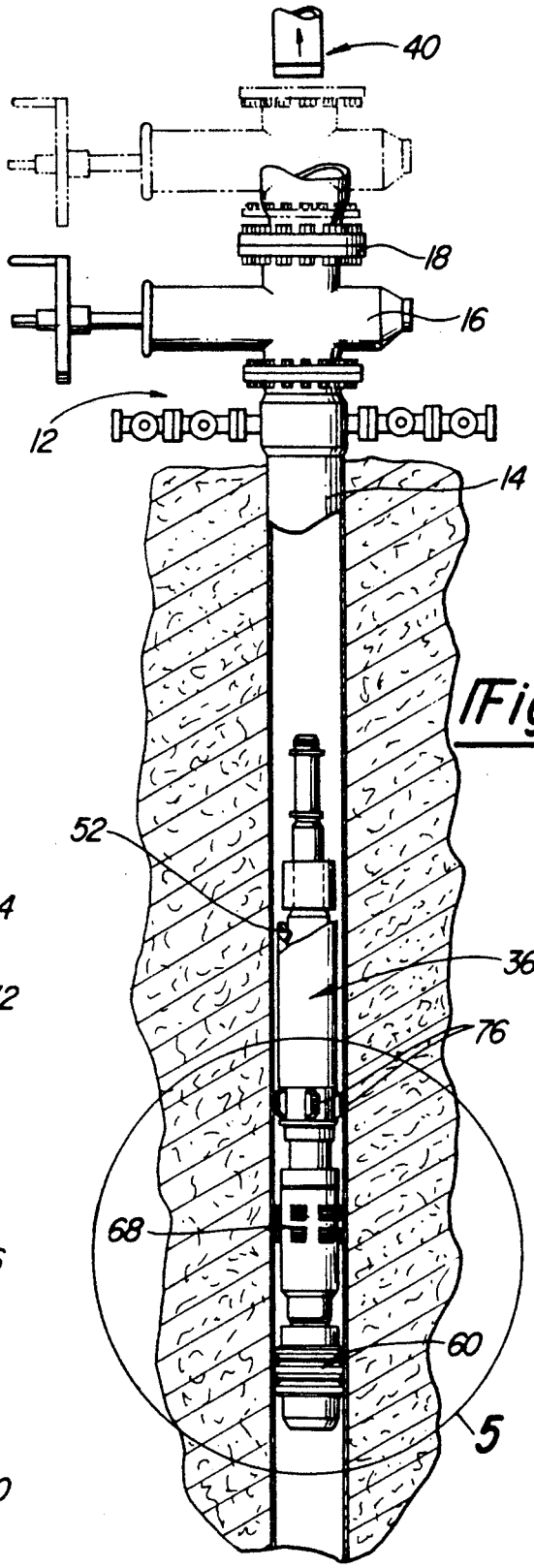
FIG. 4 is a perspective view of the present invention with the well packer set within the well bore and the wellhead shown in phantom disconnected from the well.

With the packer 36 set in the well 14, the running string 32 can be disconnected from the packer 36 to allow the wellhead 12 to be removed (FIG. 4). The hydraulic cylinders 22 are retracted to push the running string 32 towards the packer 36 approximately one inch and rotated clockwise to unlatch the upper latch 46 and allow removal of the connector sub 40 from the packer 36. By extending the arms 28 of the cylinders 22 the running string 32 and connector sub 40 are removed from the hole 14 into the lubricator 20. The wellhead valve 16 can now be replaced or repaired. Once the repairs are completed the repair unit 10 is again attached to the flange 18 of the wellhead 12.

To retrieve the packer 36 once repairs are completed, the hydraulic cylinders 22 are retracted to move the connector sub 40 and running string 32 into the well 14. The connector sub 40 will automatically engage the top of the packer 36. Continued retraction until a force of approximately 60,000 lbs. is applied will cause screw 90 to shear releasing the ratchet assembly 80 from the mandrel 42. Alternatively, the ratchet nut 84 may be threadably/rotatably disconnected from the ratchet sleeve 82 by applying rotation to the string until the ratchets release. This allows the mandrel 42 to be moved longitudinally downwardly relative to the sleeve assembly 50 releasing the packing elements 62 and the slips 70. Retraction of the cylinders 22 is continued until the lower J-latch 52 is relatched to allow removal of the packer 36. Once released, the packer 36 can be removed by extending the cylinder arms 28 to bring the packer 36 up into the lubricator 20. Thereafter, the valve 16 is closed, the blooie line 26 is opened to bleed the lubricator 20, and the repair unit 10 removed from the wellhead 12 to continue production operations.

Thus, the present invention provides a mechanically set and retrievable packer for a geothermal wellhead repair unit which can be positively set into position but can be removed to continue operation. The packer is not affected by variations in downhole pressure to isolate the wellhead.

The foregoing detailed description is given for clearness of understanding only and no unnecessary limitations should be understood therefrom as some modifications will be obvious to those skilled in the art without departing from the scope of and spirit of the appended claims.

We claim:

1. An apparatus for removal of the wellhead valve of a geothermal well, said apparatus comprising:

a lubricator having means for connecting said lubricator to the wellhead valve;

a mechanical packer positioned within said lubricator and movable through the wellhead valve into the well, including an inner mandrel and a sleeve assembly releasably attached to said mandrel, said sleeve assembly having packing means and slip means mechanically settable within the well by applying upward tension upon said mandrel relative to said sleeve assembly to isolate the wellhead valve from the well for removal of the valve;

a running tool releasably connected to said packer for applying tension to said mandrel, said running tool extending into said lubricator; and means for extending said running tool through said lubricator to move said packer into the well below the wellhead valve, said packer being mechanically set within the well upon the application of an upward tension through said running tool.

2. The apparatus as defined in claim 1 wherein said packer includes:

an inner mandrel;

a sleeve assembly releasably attached to said inner mandrel, said sleeve assembly including packing means and slip means for setting said packer; and a connector sub detachably connected to an upper end of said mandrel, said running tool connected to said connector sub.

3. The apparatus as defined in claim 2 wherein said sleeve assembly is releasably attached to said inner mandrel by latching means whereby said sleeve assembly is released from said inner mandrel and an upward tension on said mandrel through said running tool and connector sub sets said packing means and said slip means in the well.

4. The apparatus as defined in claim 3 wherein said packer includes locking ratchet means to prevent release of said packer within the well.

5. A method of isolating the wellhead of a well for the removal of the wellhead valve comprising the steps of:

attaching a lubricator assembly to the wellhead valve, said lubricator having a mechanically-set packer positioned within said lubricator, a running tool releasably connected to said packer, and means for extending said running tool through said lubricator to move said packer into the well below the wellhead valve;

extending said running tool to position said packer into the well below the wellhead valve;

unlatching an inner mandrel of said packer from a sleeve assembly of said packer to permit longitudinal movement of said inner mandrel relative to said sleeve assembly, said sleeve assembly including mechanically actuated packing means and slip means;

applying an upward tension to said running tool to move said inner mandrel longitudinally relative to said sleeve assembly to mechanically set said packer within the well below the wellhead valve; and disconnecting said running tool from said packer and retracting said running tool from the well and wellhead valve to leave said packer set within the well unaffected by fluid pressures within the well thereby isolating the wellhead for removal of the wellhead valve.

6. The method as defined in claim 5 wherein said packer is retrieved from the well to continue production by extending the running tool through the wellhead valve into the well, reconnecting said running tool to said packer, applying release tension through said running tool to said inner mandrel to release said packer from within the well, and retracting said running tool to move said packer into said lubricator.

7. The method as defined in claim 6 wherein said packer includes an inner mandrel, a sleeve assembly having slip means and packing means releasably attached to said inner mandrel, and locking ratchet means to selectively prevent release of said slip means and packing means, said running tool moving said inner mandrel in a first direction relative to said sleeve assembly to set said packer, said ratchet means selectively preventing movement of said mandrel relative to said sleeve assembly in a second direction to release said packer.

8. An apparatus for removal of the wellhead valve of a geothermal well, said apparatus comprising:

a lubricator having means for connecting said lubricator to the wellhead valve;

a mechanical packer positioned within said lubricator and movable through the wellhead valve into the well, said packer mechanically settable within the well to isolate the wellhead valve from the well for removal of the valve;

a running tool releasably connected to said packer, said running tool extending into said lubricator; and means for extending said running tool through said lubricator to move said packer into the well below the wellhead valve, said packer being mechanically set within the well upon the application of an upward tension through said running tool;

said packer including an inner mandrel, a sleeve assembly releasable attached to said inner mandrel by latching means, and having packing means and slip means for setting said packer, and a connector sub detachably connected to an upper end of said mandrel, said running tool connected to said connector sub whereby said sleeve assembly is released from said inner mandrel and an upward tension on said mandrel through said running tool and connector sub sets said packing means and slip means in the well.

9. The apparatus as defined in claim 8 wherein said packer includes locking ratchet means to prevent release of said packer within the well.

10. A method of isolating the wellhead of a well for the removal of the wellhead valve comprising the steps of:

attaching a lubricator assembly to the wellhead valve, said lubricator having a packer positioned within said lubricator, a running tool releasably connected to said packer, and means for extending said running tool through said lubricator to move said packer into the well below the wellhead valve;

extending said running tool to position said packer into the well below the wellhead valve;

unlatching an inner mandrel of said packer from a sleeve assembly of said packer to permit longitudinal movement of said inner mandrel relative to said sleeve assembly; said sleeve assembly having slip means, packing means and locking ratchet means to selectively prevent release of said slip means and packing means;

applying an upward tension to said running tool to move said inner mandrel in a first direction relative to said sleeve assembly to set said packer within the well below the wellhead valve; said ratchet means selectively preventing movement of said mandrel relative to said sleeve assembly in a second direction to release said packer; and disconnecting said running tool from said packer and retracting said running tool from the well and wellhead valve to leave said packer within the well.

* * * * *